United States Patent [19]

Brenner, Jr.

[11] 4,230,965

[45] Oct. 28, 1980

[54] MEANS FOR POSITIONING AN ELECTRICAL CONTACTOR ON A CRT MASK ASSEMBLY

[75] Inventor: Kurt H. Brenner, Jr., Seneca Falls, N.Y.

[73] Assignee: GTE Products Corporation, Stamford, Conn.

[21] Appl. No.: 38,356

[22] Filed: May 11, 1979

[51] Int. Cl.[3] ..... H01J 9/18; H01J 29/07

[52] U.S. Cl. ..... 313/407; 29/25.15

[58] Field of Search ..... 313/402, 407, 408, 404; 29/25.15

[56] References Cited

U.S. PATENT DOCUMENTS

| | | | |
|---|---|---|---|
| 3,377,493 | 4/1968 | Levin et al. | 313/407 |
| 3,541,373 | 11/1970 | Barr | 313/407 |
| 3,838,483 | 10/1974 | Baranski et al. | 29/25.15 |
| 3,931,541 | 1/1976 | Brenner, Jr. | 313/407 |

*Primary Examiner*—Palmer C. Demeo

*Attorney, Agent, or Firm*—Theodore D. Lindgren

[57] ABSTRACT

The invention represents a combination means for positioning the electrical contactor in a cathode ray tube mask-panel assembly at a temporary placement substantially contiguous to the side of the mask. Being so positioned, the danger of contactor initiated abrasion of the panel during screen fabrication is substantially eliminated. The contactor, oriented between a pair of open-end hollow rib structures on the mask, is held in retractive placement by a straddling dual pronged structure accommodated by the ribs.

8 Claims, 6 Drawing Figures

MEANS FOR POSITIONING AN ELECTRICAL CONTACTOR ON A CRT MASK ASSEMBLY

TECHNICAL FIELD

This invention relates to a combination of means for effecting temporary retractive positioning of an electrical contactor affixed to a cathode ray tube mask assembly to prevent abrasion of the coated panel sidewall during screen fabrication.

BACKGROUND ART

The envelopes of color cathode ray tubes (CRT's), of the shadow mask type often employed in color television applications, are conventionally fabricated as an integration of neck, funnel and face panel components. The glass face panel includes a viewing area, having a patterned cathodoluminescent screen interiorly formed thereon, and a perimetrical sidewall therearound. The interior of the panel, including the screen and the surrounding panel sidewall, is usually metallized with a film deposition, such as aluminum, after formation of the screen. This metallic film serves two functions: first, it provides a portion of the electrical conductive path for the screen potential, and second, it provides an efficient reflective film upon the back of the screen thereby enhancing the frontal brightness thereof. Spatially positioned within the panel component is a multiple-apertured mask component formed to have a substantially domed areal foraminous portion, the surrounding edge of which is peripherally bonded to a rigid circumscribing framing member. This composite mask assembly, often referred to as a shadow mask, is supported within the panel, in spaced relationship to the viewing area and the coated surrounding sidewall, by a plurality of suitable positional means attached to the framing member in a manner to mate with supporting studs embedded in and projecting from the sidewall of the panel.

Upon completion of the screen fabricating procedure, the aforedescribed mask-panel assembly is hermetically sealed to the funnel component of the envelope. Electron generating means in the form of an integrated assembly comprising one or more electron guns, is then positioned and sealed within the neck component of the envelope, whereupon the tube is subsequently evacuated, sealed and processed.

In shadow mask CRT's, the conventional operating screen potential is substantially that of the final anode electrode of the electron gun assembly, such being achieved by a diverse internal conductive path within the envelope. The final anode electrodes of the gun assembly usually make electrical contact through associated supportive snubber means with an electrically conductive coating, such as Aquadag, which is applied to at least a portion of the interior surface of the funnel component of the envelope. Usually, the highest operating potential is applied to this conductive coating by means of a button-type connection oriented through the wall of the funnel. The other differential potentials necessary for the successful operation of the electron guns in the assembly, are supplied to the respective electrodes therein by specific electrical conductive means terminating at the connective pins or leads traversing the closure portion and base of the tube.

The final anode potential, supplied to the conductive coating on the interior surface of the funnel, is connected to the apertured mask by at least one resilient electrical contact member affixed to the mask framing member and suitably extended therefrom to make pressured contact with the funnel disposed coating.

Exemplary electrical connection between the mask and screen components of the assembly is accomplished through the spaced-apart mask positioners conjunctively functioning with the mating mast-supporting studs proturding from the panel sidewall and the metallized film disposed thereon. The stud members are usually kept free of aluminum film deposition to avoid possible deleterious flaking of the metallic film resultant from subsequent mask positioning in the panel. Since the mask positioning means per se make riding contact on the wall-oriented mask supporting studs, electrical connection between the mask and the aluminized sidewall of the panel is provided by applying an area of an additional conductive coating, such as Aquadag, to the basal portion of at least one of the studs proper making overlapping contact with the adjacent aluminum film to insure an electrical connection between the stud and the metallized sidewall of the panel. Since application of this discrete localized area of Aquadag is usually a manual operaticn, requiring cognizance to achieve a proper deposition of coating, there have been occasions of inherent human inconsistency when the quality of the coating deposition was somewhat wanting. Faulty coating application resulted in either a prevalence of flaked or particlized coating in the vicinity of the screen and mask or an electrical connection of a quality less than desired. In addition, there was a tendency for the coating to puddle thereby accentuating the danger of accidental splattering of Aquadag on the screen.

Another means for achieving an electrical connection between the mask and panel components of the mask-panel assembly, which eliminates the need for the extra Aquadag coating, is in the form of a resilient contactor of the general type substantially disclosed in U.S. Pat. No. 3,931,541, assigned to the assignee of this invention. This referred-to connective means is substantially comprised of an attachment portion affixed to the mask framing member wherefrom integral flexural and contact portions are oriented in a manner to extend forwardly therefrom toward the screen, in the spacing existent between the mask assembly and the conductive panel sidewall. There have been instances when hurried or somewhat careless insertion resulted in undesired abrasion of the panel disposed aluminum film thereby resulting in some loss of contact surface and the possible generation of deleterious particlized material in the screen and mask regions. The present invention is addressed to means for effecting beneficial temporary retractive positioning of a forwardly oriented contactor of substantially the general type described.

DISCLOSURE OF INVENTION

The invention provides a combination means for positioning a forwardly-directed resilient electrical contactor in a CRT mask-panel assembly. The contactor has a flexural portion with an integral attachment portion affixed to the frame of the mask to provide selective temporary retractive positioning of the contactor at a placement substantially contiguous with the side of the mask. The combination effecting contactor positioning includes receiving means in the form of at least two parallel open-ended hollow-rib formations integrally oriented in spaced-apart relationship on the side of the mask in a manner that one of the ribs is on either side of the contactor. To cooperate with these ribs is a coadjuvant insertive means configurated as a pronged structure having two parallel legs projecting from a supportive transverse member. The legs are formed to provide a pair of tines dimensionally spaced for insertive accommodation within the aforedescribed hollow ribs. Sliding engagement of the transverse member along the ribs, and adjacently positioned contactor, beginning proximal to the attachment portion and continuing along the flexural portion thereof, effects the desired temporary placement of the contactor close to the frame of the mask. In this positioning, the contactor is kept out-of-the-way during the insertion and removal of the mask from the panel during screening operations. Subsequently, the insertive means is removed thereby releasing the contactor to make maximum abrasion-free contact with a conductive portion of the panel.

BEST MODE FOR CARRYING OUT THE INVENTION

For a better understanding of the present invention together with the advantages and capabilities thereof, reference is made to the following specification and appended claims in connection with the aforedescribed drawings.

Figure 1:
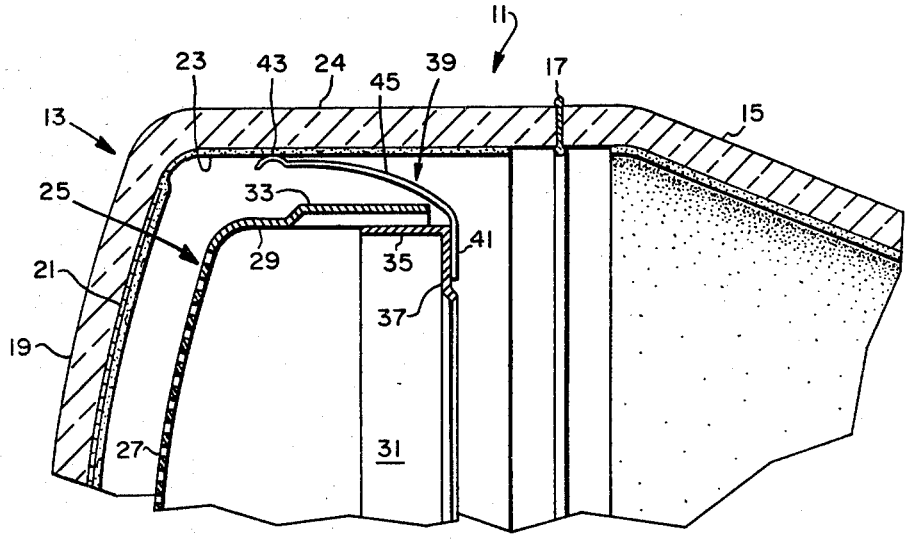
FIG. 1 is a partially sectioned view of the forward portion of a cathode ray tube wherein the invention is utilized.

With reference to the drawings, there is shown in FIG. 1, an exemplary color cathode ray tube 11 of the shadow mask variety. The panel 13 and funnel 15 components of the envelope are hermetically joined along the seal line 17. The glass panel 13 has a viewing area 19 and a perimetrical sidewall portion 24 therearound.

Disposed on the interior surface of the viewing portion of the panel 13 is a patterned cathodoluminescent screen 21 formed of a multitude of precise areas of selected color-emitting phosphor materials. Some screen constructions also employ a superimposed opaque film or matrix having multitudinous openings therein to explicitly define the respective phosphor areas, such structure is not shown in this instance. Conventionally, a thin metallized film 23, such as aluminum, is disposed over the interior surface of the screen and continued onto at least a portion of the adjacent sidewall area 24 of the panel.

Spatially oriented within the panel is a mask electrode component 25 having a multi-opening areal portion 27 precisely related to the viewing area of the screen 21. As shown, the multi-opening or foraminous area is substantially domed from a surrounding skirted portion 29 which is peripherally affixed to a rigid framing member 31. In the example shown, supportive rigidity is imparted to the foraminous skirted component by the formation of a plurality of open-ended hollow-rib means 33, oriented in spaced apart parallel relationship about the periphery of the skirted portion 29. This assembled mask component 25 is predeterminately positioned within the panel 13 by usual means such as several spaced supporting stud-like metallic members embedded in the sidewall of the panel and projecting therefrom to mate with locators attached to the side portion 35 of the framing member 31 of the mask. To promote clarity, the conventional stud-like supporting means and mask locators are not shown in the drawings. Also making up an integral part of the mask framing member 31 is a substantially perimetric ledge portion 37 terminally instanding from the side portion 35 in a manner substantially normal thereto.

Figure 5:
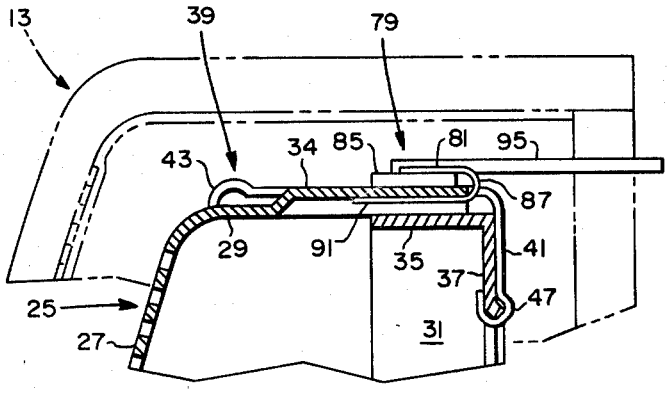
FIG. 5 is an enlarged section showing the invention taken along the line 5—5 in FIG. 4 utilizing the insertive means shown in FIG. 3.
Figure 4:
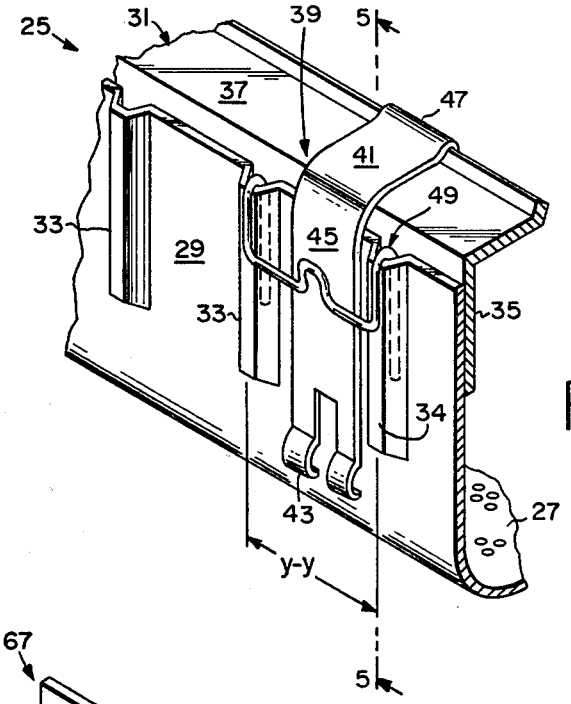
FIG. 4 is a perspective illustration of a portion of the mask delineating usage of the insertive means shown in FIG. 2.

A flexural electrical contactor 39 is affixed to the ledge portion 37 of the mask framing member in a manner to effect electrical interconnection between the mask component 25 and the metallized sidewall 24 of the panel. As shown, the electrical contactor is formed as a substantially longitudinal member of flexible resilient matallic material, having an attachment portion 41, an opposed contact portion 43, and an intermediate flexural portion 45 therebetween. As shown in FIG. 1, the attachment portion is substantially planar being affixed by bonding, such as welding, to the framing member ledge portion 37. Contactor attachment can also be accomplished, as illustrated in FIGS. 4 and 5, wherein the terminal region of the attachment portion is configurated to provide a clip-like affixture 47 which interacts in a gripping manner with the terminal edge region of the ledge portion 37. Whichever type of affixture is utilized, the flexural portion 45 of the contactor is flexurally bent or arced over the angular edge of the frame and forwardly extended in the region adjacent to the side of the framing member.

The invention relates to a combination of cooperating means for selectively positioning a mask contactor of the aforedescribed general type to effect a temporary retractive positioning of the contactor at a placement substantially contiguous with the side of the mask assembly. The invention utilizes a pair of adjacent parallel open-ended hollow-rib means 33, which are exemplarily shown in FIGS. 1, 4 and 5 as being members of a plurality of rigidity imparting formations perimetrically incorporated about the mask structure. The resilient electrical contactor 39 is affixed to the mask framing member 31 in a position between two adjacent rib means, denoted in this instance as 33 and 34, at a desired orientation on the mask structure 25.

Figure 2:
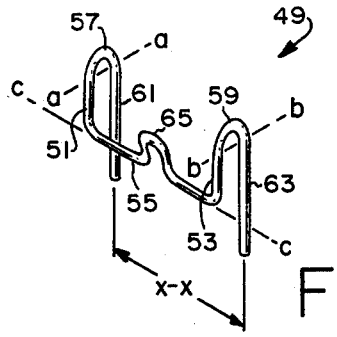
FIGS. 2 and 3 are perspective views of two embodiments of the pronged structural means of the invention.

Coadjuvant insertive means 49 formed to interact with the affixed contactor and the respective side-oriented ribs is delineated in FIG. 2. This structure as shown in this instance, is a one-piece construction fabricated as a dual pronged formation having two parallel legs 51 and 53 projecting from a supportive transverse member 55. Each of the legs has a similar substantially U-shaped bend 57 and 59 therein, each being in a respective plane "a—a" and "b—b" substantially outstanding to the plane "c—c" of the transverse member. As shown, the planes "a—a" and "b—b" are substantially normal to the plane "c—c". Being thus configurated, the terminal portions of the leg elements form a pair of spatially-related tines 61 and 63 evidencing a dimensional spacing "x" therebetween which substantially matches the dimensional spacing "y" between the respective contactor-oriented ribs 33 and 34. In the bifurcated construction shown, the tines are the longest formations of the leg elements. The supportive transverse member 55 has manipulative means 65 integral therewith to facilitate placement and removal of the pronged insertive means in the combination. By way of illustration, a loop-type configuration is formed in the transverse member and slightly angled from the plane "c—c" to provide handle means for aiding desired manipulation of the insertive means 49.

The functioning of the combination is realized by insertively accommodating the tines 61 and 63 within the contactor-related hollow ribs 33 and 34 by either manual or mechanical means. Initiating simultaneous sliding engagement of the transverse member 55 in a straddling manner along the faces of the respective ribs and the surface of flexural portion 45 of the contactor 39 beginning proximal to the attachment portion 41, and continuing progressively therefrom, effects retractive placement of the contactor in a temporary position adjacent to the side of the mask, as illustrated in FIG. 4.

Figure 6:
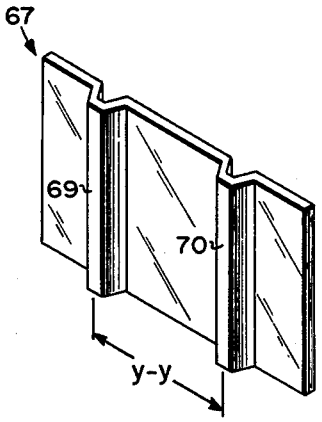
FIG. 6 is a perspective view of an embodiment of the invention wherein the rib means is a separate additive structure.

In certain mask structures, especially those employed in smaller size tubes, the rigidity-imparting plural-ribbed feature about the periphery of the foraminous portion is usually not a requirement, since the size, shaping and mass of the structure is sufficient to provide the required amount of inherent rigidity. The inventive combination can be applied to such masks by utilizing an additive ribbed structure 67 as shown in FIG. 6. This one-piece metallic member containing a pair of spaced apart hollow ribs 69 and 70, evidencing the dimensional spacing "y" therebetween, is suitably bonded to the side of the mask in the required position. Thus, the necessary hollow rib components are provided for functioning of the inventive combination as described.

The flexural contactor 39 can be affixed to the mask at the time of mask manufacturing and held in retractive positioning during storage, transportation and screen fabrication by use of the described compact and unobtrusive insertive means 49 shown in FIGS. 2 and 4. Prior to sealing the finished panel to the funnel, the insertive means 49 is facilely removed and the electrical contactor 39 is allowed to make maximum abrasion free flexural contact with the coating on the panel sidewall.

Figure 3:
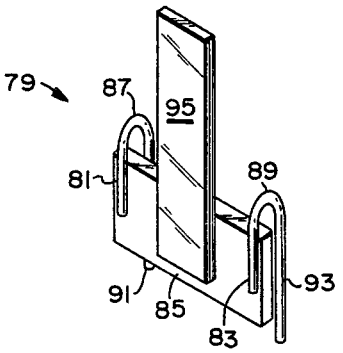

On those occasions when the electrical contactor is applied to the mask after panel aluminizing, a modified embodiment of the insertive means 79, as shown in FIGS. 3 and 5, may be employed to retract the connector while the mask is positioned within the panel. The embodiment 79 incorporates the previously noted essential elements in a plural piece structure. The two legs 81 and 83 are attached to the transverse member 85, the bends 87 and 89 in the respective legs provide the projecting tines 91 and 93, and the manipulative means integral with the transverse member is in the form of an extending handle 95. While the second embodiment represents a somewhat bulkier structure, the projecting handle means facilitates rapid manipulation for short term usage.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention, which has expeditious utilization in color cathode ray tube manufacturing, represents a combination means which is easily manipulated to conveniently and efficiently position a longitudinal forwardly-directed resilient mask electrode electrical contactor in a selected temporary retractive placement substantially contiguous with the side of the mask electrode assembly. Being so positioned, the contactor is beneficially kept out-of-the-way during the screening operations, and subsequently is easily released to make maximum abrasion-free contact with the conductive side of the finished panel prior to panel-funnel sealing. Use of the combination minimizes the prevalence of deleterious loose particles in the mask and screen regions, thus markedly improving tube quality.

While the invention is herein exemplarily described and shown as applying to a shadow mask type of CRT, the breadth of the concept is not intended to be limited thereto. For example, the expeditious contactor placement means is equally applicable to a post deflection CRT utilization, wherein a similar type of contactor is employed to supply a specific electrical potential solely to the mask-like electrode member. The panels of post-deflection CRT's are also prone to abrasion during manufacturing.

I claim:

1. Relative to a cathode ray tube mask electrode assembly, of the type spatially located within the viewing panel of a CRT, and constructionally including a multi-opening areal component peripherally attached to a rigid framing member, a combination of cooperating means for positioning a forwardly-directed resilient mask-panel electrical contactor having a flexural portion with an integral attachment portion affixed to said mask assembly to effect selective temporary retractive positioning of said electrode contactor at a placement substantially contiguous with the side of said mask assembly, said combination of cooperating contactor positioning means comprising: receiving means in the form of at least two parallel open-ended hollow-rib means integrally oriented in spaced apart relationship on the side of said mask assembly with one rib-being on either side of said contactor; and coadjuvant insertive means formed as a pronged structure having two parallel legs projecting from a supportive transverse member, said legs being formed to provide a pair of tines dimensionally spaced for insertive accommodation within said contactor-related hollow rib means whereupon the sliding engagement of said transverse member along said ribs and said contactor, beginning proximal to the attachment portion and continuing along the flexural portion thereof, effects retractive placement of said contactor.

2. The placement means for a CRT mask contactor according to claim 1 wherein said hollow-rib means are part of a plurality of such spaced apart ribs employed about the periphery of said apertured mask component to impart structural rigidity thereto.

3. The placement means for a CRT mask contactor according to claim 1 wherein said hollow rib means is a pair of ribs integrally formed as a separate one-piece metallic member for affixation to said framing member.

4. The placement means for a CRT mask contactor according to claim 1 wherein said pronged bifurcated structure is formed as a one-piece construction.

5. The placement means for a CRT mask contactor according to claim 1 wherein the supportive transverse member of said pronged structure has manipulative means integral therewith to facilitate facile movement of said structure.

6. The placement means for a CRT mask contactor according to claim 1 wherein each of said legs of said pronged structure has a similar substantially U-shaped bend therein each in a separate plane substantially outstanding to the plane of said supportive transverse member, said tines being the leg elements extending from said bends.

7. The placement means for a CRT mask contactor according to claim 6 wherein the U-shaped bends in said legs are in respective planes substantially normal to the plane of said transverse member.

8. The placement means for a CRT mask contactor according to claim 6 wherein said tines are the longest formations of said leg elements.

* * * * *